US010497329B2

(12) United States Patent
Lee et al.

(10) Patent No.: US 10,497,329 B2
(45) Date of Patent: Dec. 3, 2019

(54) DEVICE FOR CHANGING DRIVING FREQUENCY

(71) Applicant: LG DISPLAY CO., LTD., Seoul (KR)

(72) Inventors: SungGae Lee, Gunpo-si (KR); HeeJung Hong, Seoul (KR); Dong-Woo Lee, Buyeo-eup (KR)

(73) Assignee: LG Display Co., Ltd., Seoul (KR)

( * ) Notice: Subject to any disclaimer, the term of this patent is extended or adjusted under 35 U.S.C. 154(b) by 20 days.

(21) Appl. No.: 14/553,662

(22) Filed: Nov. 25, 2014

(65) Prior Publication Data

US 2015/0145901 A1 May 28, 2015

(30) Foreign Application Priority Data

Nov. 25, 2013 (KR) ..... 10-2013-0144109
Nov. 12, 2014 (KR) ..... 10-2014-0156716

(51) Int. Cl.
*G09G 3/36* (2006.01)

(52) U.S. Cl.
CPC ..... *G09G 3/3614* (2013.01); *G09G 2310/08* (2013.01); *G09G 2320/0247* (2013.01); *G09G 2320/0257* (2013.01); *G09G 2320/103* (2013.01); *G09G 2330/021* (2013.01)

(58) Field of Classification Search
CPC ..... G09G 2340/0435; G09G 2360/18; G09G 2330/021; G09G 2320/103; G09G 2320/106
See application file for complete search history.

(56) References Cited

U.S. PATENT DOCUMENTS

2002/0186192 A1* 12/2002 Maruoka ..... G09G 3/2011 345/87
2007/0200838 A1* 8/2007 Lee ..... G09G 5/12 345/204
2008/0239179 A1* 10/2008 Kasai ..... G09G 3/3648 349/34
2008/0291183 A1* 11/2008 Koyama ..... G09G 3/2092 345/204

(Continued)

FOREIGN PATENT DOCUMENTS

CN 101031042 A 9/2007
CN 101995694 A 3/2011

(Continued)

OTHER PUBLICATIONS

Office Action dated Sep. 2, 2016 for Chinese Application No. 201410691221.8, 7 pages.

(Continued)

*Primary Examiner* — Yuzhen Shen
(74) *Attorney, Agent, or Firm* — Seed Intellectual Property Law Group LLP

(57) ABSTRACT

A display device and a method of driving the same. The display device includes a display panel on which a plurality of data lines and a plurality of gate lines intersect each other to form a matrix, with a number of pixels being defined at intersections of the plurality of data lines and the plurality of gate lines. A data driver is connected to the plurality of data lines. A gate driver is connected to the plurality of gate lines. A timing controller controls the display panel to operate in a driving mode that changes depending on image signals.

15 Claims, 18 Drawing Sheets

(56) References Cited

U.S. PATENT DOCUMENTS

| | | | | |
|---|---|---|---|---|
| 2009/0268089 | A1* | 10/2009 | Mori | H04N 21/4854 348/459 |
| 2009/0310018 | A1* | 12/2009 | Sakashita | G09G 3/3614 348/448 |
| 2011/0057914 | A1* | 3/2011 | Nam | G09G 3/3648 345/211 |
| 2012/0062552 | A1* | 3/2012 | Bae | H04N 13/0029 345/419 |
| 2012/0133635 | A1* | 5/2012 | Ji | G09G 3/3688 345/212 |
| 2013/0088479 | A1* | 4/2013 | Kim | G09G 3/3614 345/212 |

FOREIGN PATENT DOCUMENTS

| | | | |
|---|---|---|---|
| CN | 103366707 | A | 10/2013 |
| CN | 102542980 | A | 7/2016 |
| JP | P2002-291743 | A | 10/2002 |

OTHER PUBLICATIONS

Chinese Third Office Action, dated Jan. 2, 2018, for Chinese Application No. 201410691221.8, 15 pages. (with English Translation).

* cited by examiner

DEVICE FOR CHANGING DRIVING FREQUENCY

CROSS REFERENCE TO RELATED APPLICATION

This application claims priority from and the benefit under 35 U.S.C. § 119(a) of Korean Patent Application Number 10-2013-0144109 filed on Nov. 25, 2013 and Korean Patent Application Number 10-2014-0156716 filed on Nov. 12, 2014, which are hereby incorporated by reference for all purposes as if fully set forth herein.

BACKGROUND

Field of the Invention

The present disclosure relates to a display device and a method of driving the same.

Description of Related Art

In response to the growth of the information society, there is an increasing demand for various types of image display devices. Currently, various display devices such as liquid crystal displays (LCDs), plasma display panels (PDPs) and organic light-emitting diode displays (OLEDs) are used.

Display devices such as LCDs and OLEDs drive a panel at a fixed drive frequency regardless of the type of input image. Therefore, although an input image may be almost still, as in a document, power consumption constantly occurs due to voltage transition or data transition.

An LCD is a device which includes an array substrate including thin-film transistors (TFTs), an upper substrate including, for example, a color filter and/or black matrix, and a liquid crystal layer disposed between the substrates. The LCD displays an image by adjusting the orientation of the liquid crystal layer in response to an electric field applied between two electrodes in a pixel area and thus controlling the transmittance of light.

The LCD is driven by inversion driving in which polarity inversion occurs between adjacent liquid crystal cells and by a frame period in order to reduce direct current (DC) offset components and suppress the deterioration of the liquid crystal. Here, the LCD is constantly driven by the same inversion driving regardless of the type of image signals.

Display devices such as LCDs and OLEDs always operate in the same mode regardless of the types of images, sometimes causing waste during power consumption. In particular, although the inversion driving and the driving speed are main reasons for power consumption in LCDs, they are always constant regardless of the types of image signals, thereby sometimes causing waste during power consumption.

SUMMARY

A display device includes: a display panel on which a plurality of data lines and a plurality of gate lines intersect each other to form a matrix, with a number of pixels being defined at intersections of the plurality of data lines and the plurality of gate lines; a data driver connected to the plurality of data lines; a gate driver connected to the plurality of gate lines; and a timing controller which controls the display panel to operate in a driving mode that changes depending on image signals.

In another aspect, a method of driving a display device includes: receiving image signals of a predetermined frame; calculating a difference in data value between the image signals of the predetermined frame or levels of complexity of the image signals of adjacent frames; and controlling a display panel to operate in a driving mode selected from the group consisting of dot inversion, a column inversion and frame inversion depending on the difference in the data value between the image signals of the predetermined frame or the levels of complexity of the image signals of the predetermined frame.

In a further aspect, a display device includes: a display panel on which a plurality of data lines and a plurality of gate lines intersect each other to form a matrix, with a number of pixels being defined at intersections of the plurality of data lines and the plurality of gate lines; a data driver connected to the plurality of data lines; a memory storing an image signal of a first drive frequency input from a host system; and a timing controller controlling the display panel to be driven with an image signal of a second drive frequency obtained from the image signal stored in the memory by data multiplying, the second drive frequency being m times the first drive frequency, where m is a real number greater than 1.

According to the present invention as set forth above, it is possible to minimize power consumption since the display panel operates in the driving mode that changes depending on an image signal of the display device.

DETAILED DESCRIPTION OF THE EXEMPLARY EMBODIMENTS

Figure 1:
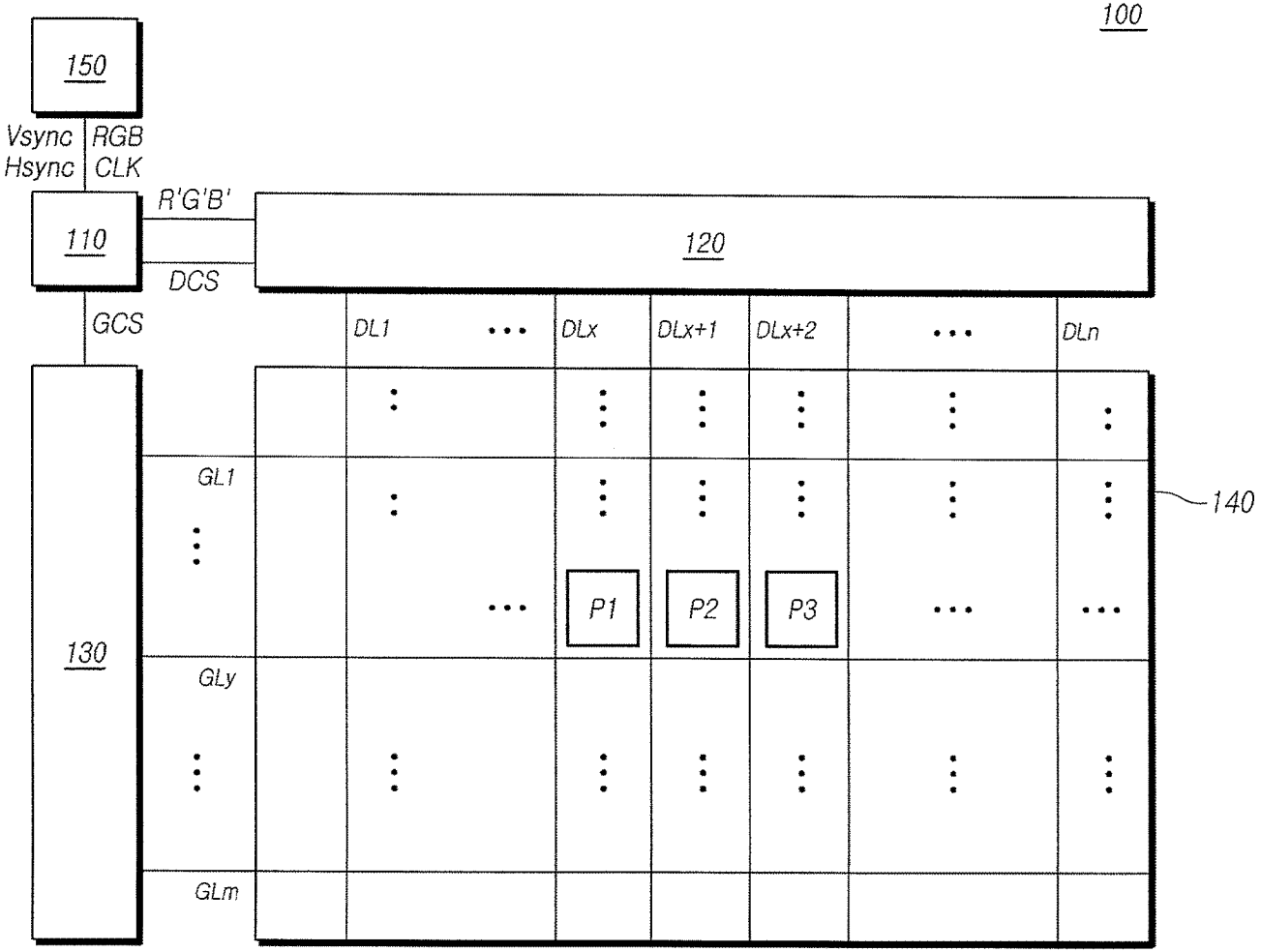
FIG. 1 is a view showing the system configuration of a display device to which exemplary embodiments are applied.

Reference will now be made in detail to the embodiments of the present invention, which are illustrated in the accompanying drawings. Throughout this document, reference should be made to the drawings, in which the same reference numerals and signs may be used throughout the different drawings to designate the same or similar components. In the following description of the present invention, detailed descriptions of known functions and components incorporated herein will be omitted when they may make the subject matter of the present invention unclear.

It will be understood that, although terms "first," "second," "A," "B," "(a)," "(b)," etc. may be used herein to describe various elements, these terms are only used to distinguish one element from another element. The substance, sequence, order or number of these elements are not limed by these terms. It will be understood that when an element is referred to as being "connected to" or "coupled to" another element, not only can it be "directly connected" or "coupled to" the other element, but also can it be "indirectly connected or coupled to" the other element via an "intervening" element. In the same context, it will be understood that when an element is referred to as being formed "on" or "under" another element, not only can it be directly formed on or under another element, but also can it be indirectly formed on or under another element via an intervening element.

FIG. 1 is a view showing the system configuration of a display device to which exemplary embodiments of the present invention are applied.

Referring to FIG. 1, the display device 100 includes a timing controller 110 which controls the operation of a display panel 140, a data driver 120 connected to a plurality of data lines, a gate driver 130 connected to a plurality of gate lines, and the display panel 140 on which the plurality of data lines and the plurality of gate lines intersect each other in the form of a matrix in which pixels are defined at the intersections. The display device 100 further includes a host system 150.

The display panel 140 can be a display panel used in flat panel display devices such as liquid crystal displays (LCDs), plasma display panels (PDPs) and organic light-emitting diode displays (OLEDs). Hereinafter, the display panel 140 will be described, by way of example, as being applied to an LCD.

The host system 150 supplies timing signals, such as vertical and horizontal synchronization signals Vsync and Hsync, a data enable signal DE and a clock signal CLK, to the timing controller 110. The host system 150 also supplies image signals RGB to the timing controller 110.

The timing controller 110 receives timing signals, such as vertical and horizontal synchronization signals Vsync and Hsync, a data enable signal DE and a clock signal CLK, and generate control signals for controlling the operation timing of the data driver 120 and the gate driver 130. In addition, the timing controller 110 samples image signals inputted from the host system 150, reorders the sampled image signals, and then supplies the reordered image signals to the data driver 120.

Here, the vertical synchronization signal Vsync and the horizontal synchronization signal Hsync are signals in use for the synchronization of an image signal RGB. The vertical synchronization signal Vsync is a signal for discriminating a frame and is inputted frame by frame. The horizontal synchronization signal Hsync is a signal for discriminating a gate line in one frame and is inputted gate line by gate line The data enable signal DE indicates a session where effective data are located, in particular, a point of time from which data are supplied to a pixel.

The vertical synchronization signal Vsync, the horizontal synchronization system Hsync and the data enable signal DE are based on the clock signal CLK.

The data driver 120 latches digital video data RGBodd and RGBeven under the control of the timing controller 110, generates a positive/negative analog data voltage by converting the digital video data into a positive/negative gamma compensation voltage, and supplies the data voltage to the data lines D1 to Dm.

The gate driver 130 includes a shift register, a level shifter which converts an output signal of the shift register into a signal having a swing width suitable for TFT driving of liquid crystal cells, and an output buffer connected between the level shifter and the gate lines GL1 to GLm. The gate driver 130 sequentially outputs scan pulses having a pulse width of approximately one horizontal period.

When the display panel 140 is, for example, an LCD panel, the LCD panel 140 includes liquid crystal molecules sandwiched between two substrates. On the first substrate of the LCD panel 140, an n number of data lines DL1 to DLn and an m number of gate lines GL1 to GLm intersect each other. The LCD panel 140 includes an n*m number of liquid crystal cells Clc arranged in the shape of a matrix, attributable to the intersection structure on the first substrate defined by the number of data lines DL1 to DLn and the m number of gate lines GL1 to GLm. The data lines DL1 to DLn, the gate lines GL1 to GLm, thin-film transistors (TFTs), pixel electrodes PXL of the liquid crystal cells Clc connected to the TFTs, storage capacitors Cst and the like are formed on the first substrate of the liquid crystal display panel 140.

A black matrix and a color filter are formed on the second substrate of the LCD panel 140. Common electrodes are formed on the second substrate in a vertical field driving system using, for example, twisted nematic mode (TN mode) or vertical alignment mode (VA mode). In contrast, the common electrodes are formed together with the pixel electrodes on the first substrate in a horizontal field driving system using, for example, in-plane switching (IPS) or fringe field switching (FFS). A polarizer plate having an orthogonal optical axis is attached to each of the first and second substrates of the LCD panel 140. An alignment layer is formed on each inner surface of the first and second substrates, which adjoins to the liquid crystal layer, in which a free tilt angle of the liquid crystal is set with the alignment layer.

The above-mentioned timing controller 110 can control the display panel to operate in a driving mode that changes depending on the image signal.

As in a first embodiment, which will be described later, when the display panel 140 is an LCD panel, this driving mode can be inversion driving, such as dot inversion, line inversion and frame inversion. When the driving mode is the inversion driving, the timing controller 110 can control the display panel 140 to be driven by the inversion driving that changes depending on a total of differences between data values of image signals of a specific frame which are in a specific direction.

In addition, as in a second embodiment, which will be described later, this driving mode can be frequency driving in which the frame drive frequency of the display panel 140 is controlled.

In one example, the timing controller 110 can control the display panel 140 to be driven at a drive frequency that changes depending on a variation in image signals between adjacent frames. The variation in the image signals can be calculated as a total of gray differences of image signals between adjacent frames.

In another embodiment, the timing controller 110 can control the display panel 140 to be driven at a drive frequency that changes depending on the complexity of image signals within a specific frame.

In a further embodiment, the timing controller 110 can control the display panel 140 to be driven at a first drive frequency depending on a variation in image signals between adjacent frames and at a second drive frequency depending on the complexity of image signals within a specific frame.

First Embodiment

Figure 2:
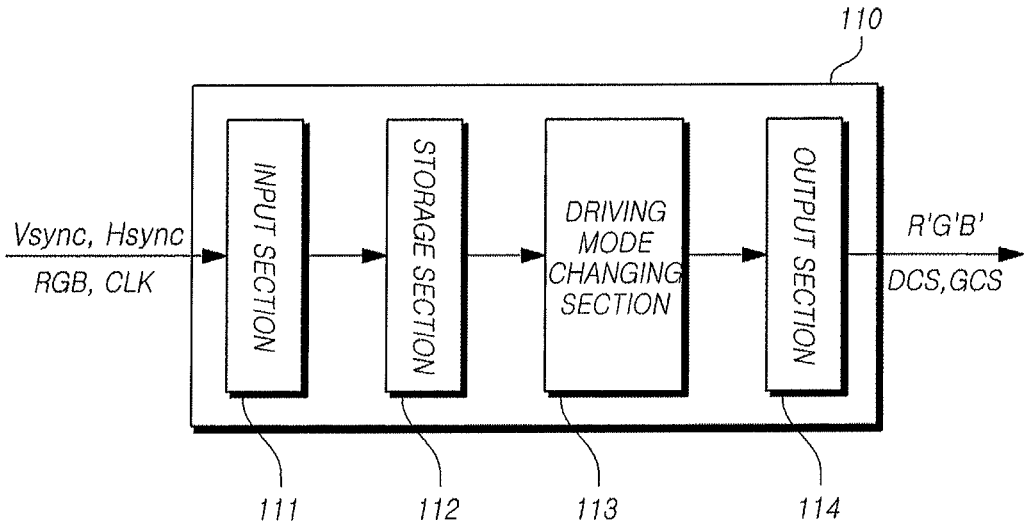
FIG. 2 is a detailed view showing an exemplary embodiment of the timing controller shown in FIG. 1.

FIG. 2 is a detailed view showing an exemplary embodiment of the timing controller shown in FIG. 1.

Referring to FIG. 2, the timing controller 110 includes a input section 111 which receives timing signals Vsync, Hsync and DE and an image signal RGB transmitted from the host system 150, a storage section 112 which stores the image signals received from the input section 111, a driving mode changing section 113 which analyzes the image signals and changes a driving mode depending on the image signals, and an output section 114 which outputs image signals and control signals according to the changed driving mode to the display panel 140.

As described above, when the display panel 140 is an LCD panel, the driving mode changing section 113 changes inversion driving from among dot inversion, line inversion and frame inversion.

The LCD panel 140 drives the liquid crystal sandwiched between the first and second substrates by alternately charging and holding a voltage. A drive frequency is determined depending on how often the voltage is charged and held. The LCD panel 140 is typically driven at 60 Hz (National Television System Committee mode (NTSC mode)). Power consumption at this time changes under the influence of the voltage transition or data transition of the liquid crystal as well as the drive frequency.

$$\text{Power consumption} = \frac{1}{2}cfv^2 \qquad \text{Formula 1}$$

In Formula 1 above, c is a constant that indicates a load capacitance, f indicates a drive frequency, and v indicates a drive voltage. Here, the constant c corresponds to a design value.

As apparent from Formula 1 above, "v" corresponding to voltage transition is most significant in power consumption, and changes depending on the type of images or the inversion driving of the LCD panel 140. It is also possible to change power consumption by changing the drive frequency f.

Figure 3:
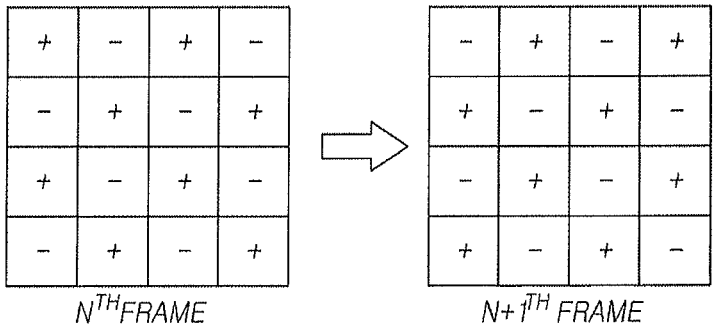
FIG. 3 is a conceptual view showing dot inversion driving.
Figure 4:
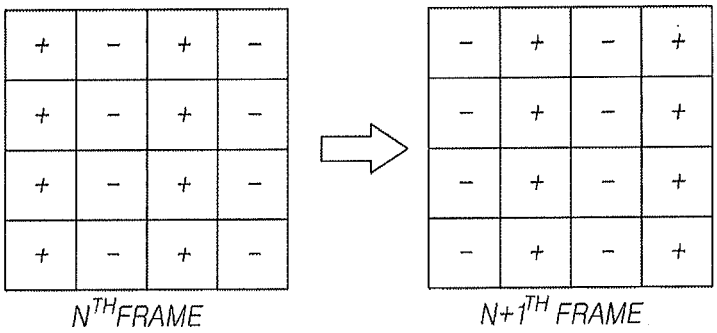
FIG. 4 is a conceptual view showing column inversion driving.

The inversion driving typically includes dot inversion driving and column inversion driving, as shown in FIG. 3 and FIG. 4. As shown in FIG. 3, the dot inversion driving drives all adjacent dots of the liquid crystal at opposite polarities and inverts these polarities on a frame-by-frame basis. As shown in FIG. 4, the column inversion driving causes all pixels in each column to have the same polarity but the pixels in different rows to have different polarities. These polarities convert on a frame-by-frame basis. Herein, the words "row" and "column" are relative terms, i.e. the column inversion driving may drive all pixels in each row at the same polarity but all pixels in each column at opposite polarities.

The dot inversion driving can have better image quality, whereas the column inversion driving is advantageous in reducing power consumption. The column inversion driving can be more advantageous when voltage transition in a column is greater since all pixels in each column have the same polarity. In contrast, when a change in voltage transition in a column is insignificant, the column inversion driving is less advantageous and may cause a problem in image quality such as crosstalk. Although the driving mode is usually fixed, the display device 100 according to this embodiment can change the inversion driving by analyzing image signals.

The driving mode changing section 113 can change the driving mode between the column inversion driving and the dot inversion driving depending on a difference between data values of image signals of an Nth frame which are in a specific direction, for example, a row direction. Specifically, the driving mode changing section 113 changes the driving mode into the dot inversion driving when the difference in the data value between the image signals of the Nth frame is equal to or greater than a reference value and to the column inversion driving when the difference is less than the reference value.

Specifically, the driving mode changing section 113 performs a difference operation in a row direction, as expressed by $V_{i+1j}-V_{ij}$, on gray scales of the image signals RGB in Formula 2, which correspond to data values of the image signals in the Nth frame.

$$RGB = \left[\begin{pmatrix} V_{11} & \dots & V_{1m} \\ \vdots & \ddots & \vdots \\ V_{n1} & \dots & V_{nm} \end{pmatrix}\right] \qquad \text{Formula 2}$$

Here, Vxy indicates a gray scale of an image signal in a pixel in an Xth column (where X ranges from 1 to n) and a Yth row (where Y ranges from 1 to m).

As expressed in Formula 3, the driving mode changing section 113 calculates the difference between data values of image signals of the entire Nth frame, which are in a row direction, by adding up difference operation values $V_{i+1j}-V_{ij}$, which are in the row direction, and then adding up the values, which are added up in a column direction. When the difference in the data value between the image signals is equal to or greater than a reference value, the display device 100 can change the driving mode into the dot inversion driving, as shown in FIG. 3. When the difference in the data value between the image signals is less than the reference value, the display device 100 can change the driving mode into the column inversion driving, as shown in FIG. 4.

$$\Sigma_{i=1}^{n-1}\Sigma_{j=1}^{m}(v_{i+1j}-v_{ij}) \quad \text{Formula 3}$$

Although the inversion driving mode was illustrated as changing between the dot inversion driving and the column inversion driving in this embodiment, the present invention is not limited thereto. Specifically, the driving mode changing section 113 calculates a difference between data values of image signals of the entire Nth frame, which are in the row direction, by adding up difference operation values $V_{i+1j}-V_{ij}$, which are in the row direction, and then adding up the values, which are added up in the column direction, as expressed in Formula 3. Afterwards, when the difference in the data value between the image signals is equal to or greater than a reference value, the driving mode changing section 113 changes the driving mode into the dot inversion driving, as shown in FIG. 3. Alternatively, when the difference in the data value between the image signals is less than the reference value, the driving mode changing section 113 calculates and adds up data values and gray differences of adjacent pixels. After that, the driving mode changing section 113 can change the driving mode into frame inversion driving when the added-up value is less than the reference value and into the column inversion driving shown in FIG. 4 when the added-up value is not less than the reference value.

In addition, although it was illustrated in this embodiment that the driving mode changing section 113 calculates the difference in the data value between the image signals of the entire Nth frame, which are in the row direction, by adding up the difference operation values $V_{i+1j}-V_{ij}$, which are in the row direction, and then adding up all the values, which are added up in the column direction, the present invention is not limited thereto. For example, the driving mode changing section 113 can add up the difference operation values $V_{i+1j}-V_{ij}$, which are in the row direction, and then calculate the difference in the data value between the image signals of the entire Nth frame, which are in the row direction, using an average or standard deviation of the values, which are added up in the column direction.

In brief, the driving mode changing section 113 can change the inversion driving depending on the difference in the data value between the image signals of the Nth frame.

The output section 114 outputs an image signal R'G'B' and a control signal, which are reordered according to the inversion driving changed by the driving mode changing section 113, to the display panel 140 such that the display panel 140 is driven by the changed inversion driving. The control signals include a gate control signal GCS and a data control signal DCS.

The output section 114 can generate various control signals according to the changed inversion driving and output these control signals to the gate driver and data driver.

The control signals include a gate start pulse (GSP), a gate shift clock signal (GSC) and a gate output enable signal (GOE) as gate control signals (GCSs). The GSP indicates a start horizontal line where scanning starts in one vertical period during which one screen is displayed. The GSC is a timing control signal which is inputted to a shift register inside the gate driver 130 in order to sequentially shift the GSP, and is generated at a pulse width corresponding to the ON period of a thin-film transistor (TFT). The GOE indicates an output of the gate driver 130.

In addition, the control signals include a source start pulse (SSP), a source sampling clock signal (SSC) and a source output enable signal (SOE) as data control signals (DCSs). The SSP indicates a start pixel in one horizontal line where data are to be displayed. The SSC indicates a data latch operation inside the data driver 120 based on a rising or falling edge. The SOE indicates an output of the data driver 120. When the display panel 140 is an LCD panel, a reference polarity control signal (POL), which is a data control signal (DCS) from among the control signals, indicates the polarity of a data voltage that is to be supplied to liquid crystal cells Clc of the LCD panel 140.

Second Embodiment

Figure 5:
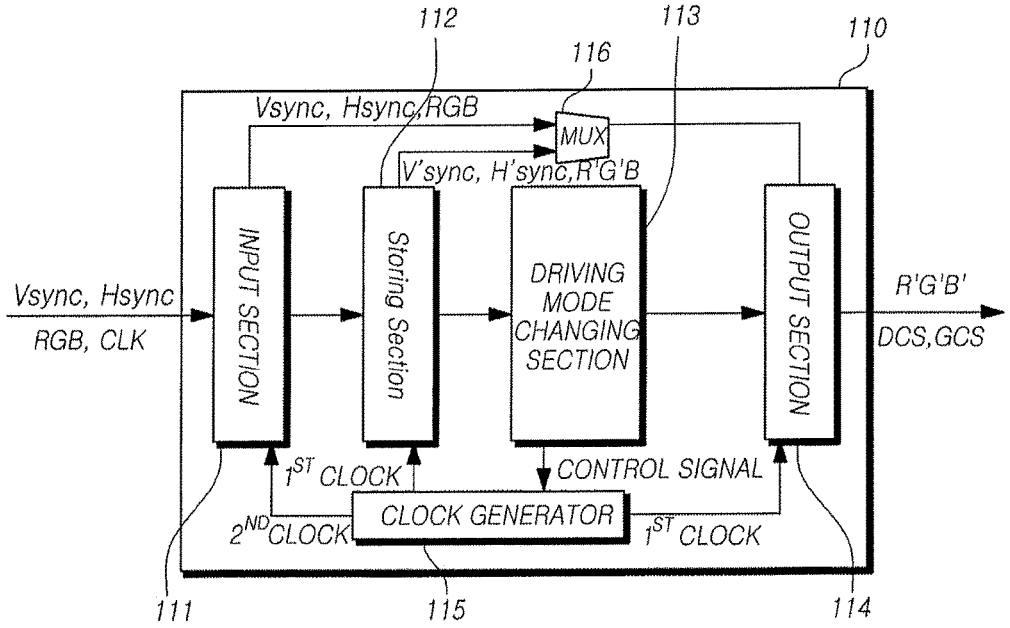
FIG. 5 is a detailed view showing another exemplary embodiment of the timing controller shown in FIG. 1.

FIG. 5 is a detailed view showing another exemplary embodiment of the timing controller shown in FIG. 1.

Referring to FIG. 5, the timing controller 110 includes a input section 111 which receives timing signals and image signals transmitted from the host system 150, a storage section 112 which stores the image signals received from the input section 111, a driving mode changing section 113 which analyzes the image signals and changes the driving mode depending on the image signals, and an output section 114 which outputs image signals and control signals according to the changed driving mode to the display panel 140. The timing controller 110 also includes a clock generator 115 which generates a first clock acting as a standard clock and a second clock acting as a reference clock and a multiplexer (MUX) 115 which outputs one signal from among the image signals and control signals, which are inputted from the input section 111, and the image signals and the control signals, which are generated according to the driving mode that changes depending on the image signals. The output section 114 outputs the image signals and the control signals outputted from the MUX 116 to the display panel 140.

For moving images having a significant variation in image signals, a drive frequency of 60 Hz or higher is required in order to express a smooth motion. Considering some aspects such as motion blur, it is not preferable to reduce the drive frequency. However, the drive frequency can be reduced in the case of moving images, in which variation in an image signal is insignificant, or still images, since there are no significant movements. Since flickering may occur when the drive frequency is reduced excessively, the driving mode changing section 113 can analyze the image signals or images and adjust the drive frequency according to the analysis.

In an example, the driving mode changing section 113 can change the drive frequency of an Nth frame depending on a variation in image signals between the Nth frame and an adjacent frame, for example, the N−1th frame. In this case, the variation in the image signals can be calculated as a total of gray differences of image signals between the Nth and N−1th frames. The drive frequency can be divided into a frequency for ordinary driving and a frequency for low speed driving. The frequency for low speed driving includes all cases the frequency of which is lower than the frequency for ordinary driving.

First, the driving mode changing section 113 calculates the variation in the image signals of the adjacent Nth and N−1th frames by obtaining gray differences of the image signals between the adjacent frames. When the variation in the image signals is equal to or greater than a reference amount, it is possible to change the drive frequency of the Nth frame to the frequency for ordinary driving, for example, 60 Hz. When the variation is less than the reference amount, it is possible to change the drive frequency of the Nth frame to the frequency for low speed driving, for example, 40 Hz.

Specifically, when the display device 100 having XGA-level resolution (1024*768) is driven in the frequency for ordinary driving, a vertical synchronization signal Vsync has a frequency of 60 Hz, a horizontal synchronization signal Hsync has a frequency of 48.4 KHz, and a pixel frequency has a frequency of 65 MHz. When the variation in the image signals between the adjacent frames is less than the reference amount, the driving mode changing section 113 can change the drive frequency to the frequency for low speed driving, for example, 40 Hz, which is lower than the frequency for ordinary driving.

Third Embodiment

In a third exemplary embodiment, the driving mode changing section 113 can change the drive frequency of an Nth frame depending on the complexity of image signals within the Nth frame.

Theoretically, flickering in an image may originate from different levels of voltage transition since pixels included in the image have different pixel values. At 60 Hz, even if the variation is very small due to the optimization of a common voltage, it may be noticeable when the drive frequency is high. When the drive frequency is reduced, the optimum position of the common voltage also changes. The low drive frequency causes even a minute variation to be clearly observed. When different gray scales are scattered on the screen, flickering becomes evident due to deviations in which the gray scales have different optimum common voltages. Therefore, the driving mode changing section 113 produces a proper drive frequency by calculating the complexity and setting a suitable range of the complexity.

Specifically, the driving mode changing section 113 can calculate the complexity having weights depending on gray differences between adjacent pixels within a specific frame, for example, the Nth frame, and then change the drive frequency depending on the complexity (a total of the weights) of image signals. In an example, the driving mode changing section 113 calculates gray differences between adjacent pixels within the Nth frame, for example, 58, 150, 25 and 85 gray scales, as shown in part (a) of FIG. 6, and calculates the complexity by adding up the gray differences, as shown in part (b) of FIG. 6. The driving mode changing section 113 determines the drive frequency of the Nth frame depending on the complexity that is calculated in this manner. For example, when the calculated complexity ranges from 9,000,000 to 12,000,000, as shown in part (c) of FIG. 6, the driving mode changing section 113 can change the drive frequency of the Nth frame to 40 Hz, as shown in part (d) and part (e) of FIG. 6. In other words, as shown in part (c) to part (e) of FIG. 6, the drive frequency can be predetermined depending on the complexity, and the driving mode changing section 113 can change the drive frequency of the Nth frame depending on the predetermined complexity.

In another example, the driving mode changing section 113 can determine a first drive frequency of an Nth frame depending on a variation in image signals between the Nth frame and the adjacent N−1th frame by combining the above-mentioned examples, and then change the first drive frequency with a second drive frequency depending on the complexity of image signals within the Nth frame. For example, the driving mode changing section 113 can determine the drive frequency of the Nth frame to be the first drive frequency (e.g. 40 Hz) depending on the variation in the image signals between the adjacent Nth and N−1th frames by combining the above-mentioned examples, and then change the drive frequency of the Nth frame to the second drive frequency (e.g. 30 Hz) that is lower than the first drive frequency depending on the complexity of the image signals within the Nth frame. In this case, the second drive frequency may be independent of the first drive frequency, and may be equal to or lower than the first drive frequency. However, the present invention is not limited thereto, and the second drive frequency can be higher than the first drive frequency.

In other words, the driving mode changing section 113 can determine the drive frequency of the Nth frame to be the first drive frequency, i.e. 40 Hz, depending on the variation in the image signals between the adjacent Nth and N−1th frames, and then maintain the first drive frequency or change the first drive frequency with the lower second drive frequency depending on the complexity of the image signals within the Nth frame.

The driving mode changing section 113 includes a variable drive frequency algorithm block, which comprises software, hardware or a combination thereof. The variable drive frequency algorithm block can output a drive frequency control signal with which the drive frequency of a specific frame is changed to the frequency for ordinary driving (e.g. 60 Hz) or the frequency for low speed driving (e.g. 40 Hz), which is lower than the frequency for ordinary driving, depending on a variation in image signals between the specific frame and an adjacent frame or the complexity of an image signal within the specific frame.

The clock generator 115 can generate first and second clocks in response to the drive frequency control signal and then output the first clock to the storage section 112 and the output section 114. In response to the first clock being received, the storage section 112 outputs vertical and horizontal synchronization signals V'sync and H'sync, a data enable signal DE' and an image signal R'G'B', which are reordered in response to the first clock, to the MUX 116. The MUX 116 receives vertical and horizontal synchronization signals Vsync and Hsync, data enable signal DE and an image signal RGB from the input section 111, which are received from the host system 150. In addition, the clock generator 115 can output the second clock, which is used in programming, to the input section 111.

In response to a selection signal, the MUX 116 outputs one signal selected from among the vertical and horizontal synchronization signals Vsync and Hsync, the data enable signal DE and the image signal RGB, which are received from the input section 111, and the vertical and horizontal synchronization signals V'sync and H'sync, the data enable signal DE' and the image signal R'G'B', which are reordered and received from the storage section 112. At this time, the selection signal inputted to the MUX 116 can be generated by the driving mode changing section 113 or the host system 150.

The output section 114 outputs the control signal and the image signals, which are outputted from the MUX 116, to the display panel 140. The output section 114 can generate a variety of control signals (GCS and DCS), such as a gate start pulse (GSP), a gate shift clock signal (GSC), a gate output enable signal (GOE), a source start pulse (SSP), a source sampling clock signal (SSC), a source output enable signal (SOE) and a reference polarity control signal (POL), and output these control signals to the gate driver and the data driver.

Figure 7:
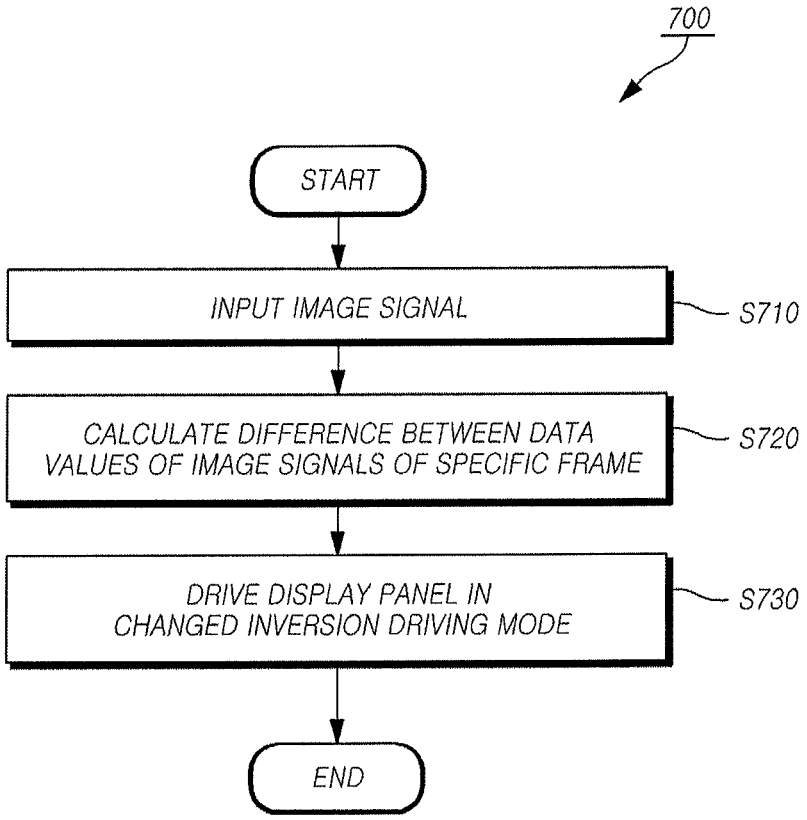
FIG. 7 is a flowchart showing an exemplary embodiment of a method of driving a display device according to the present invention.

FIG. 7 is a flowchart showing an exemplary embodiment of a method of driving a display device according to the present invention.

Referring to FIG. 1 and FIG. 7, the method of driving a display device (hereinafter also referred to as the "display device driving method") 700 according to this embodiment includes step S710 of receiving image signals of a specific frame, step S720 of calculating a difference in the data value between the image signals of the specific frame, and step S730 of controlling a display panel to operate in one driving mode selected from among dot inversion, column inversion and frame inversion depending on the difference between image signals of the specific frame.

At step S710, the display device 100 receives an image signal RGB and timing signals Vsync, Hsync and DE transmitted from the host system 150. Although the inputted image signal RGB and the timing signals Vsync, Hsync and DE are stored in the display device 100, these signals can be stored temporarily and then deleted.

At step S720, the display device 100 calculates the difference in the data value between the image signals of the specific frame. Specifically, the display device 100 performs a difference operation in a row direction, as expressed by $V_{i+1j}-V_{ij}$, on gray scales of the image signal RGB of Formula 2, which correspond to the data values of the image signals of the specific frame. Afterwards, the display device 100 calculates a difference between data values of image signals of the entire Nth frame, which are in the row direction, by adding up difference operation values $V_{i+1j}-V_{ij}$, which are in the row direction, and then adding up the values, which are added up in a column direction, as expressed in Formula 3.

Afterwards, at step S730, when the difference in the data value between the image signals is equal to or greater than a reference value, the display device 100 can change the driving mode into the dot inversion driving, as shown in FIG. 3. Alternatively, when the difference in the data value between the image signals is less than the reference value, the display device 100 can change the driving mode into the column inversion driving, as shown in FIG. 4.

In addition, at step S720, the display 100 can calculate the difference in the data value between the image signals of the entire Nth frame, which are in the row direction, by adding up the difference operation values $V_{i+1j}-V_{ij}$, which are in the row direction, and then adding up the values which are added up in the column direction. In this case, at step S730, when the difference in the data value between the image signals of the entire Nth frame is equal to or greater than the reference value, the driving mode is changed to the dot inversion driving, as shown in FIG. 3. Alternatively, when the difference in the data value between the image signals of the entire Nth frame is less than the reference value, data values and gray differences of adjacent pixels of the Nth frame are calculated and added up. After that, the driving mode can be changed into the frame inversion driving when the added-up value is less than the reference value and into the column inversion driving shown in FIG. 4 when the added-up value is not less than the reference value.

At step S730, the display device 100 can generate various control signals according to the changed inversion driving mode and output these control signals to the gate driver and data driver.

According to the display device driving method 700 of this embodiment, the display device 100 outputs an image signal R'G'B' and a control signal, which are reordered according to the changed inversion driving, to the display panel 140 such that the display panel 140 is driven by the changed inversion driving.

Although it was illustrated in this embodiment that the display device 100 calculates the difference in the data values of the image signals of the specific frame and controls the display panel to operate in one driving mode selected from among dot inversion, column inversion and frame inversion depending on the calculated difference between the data values, the present invention is not limited thereto. For example, the display device, for example, the timing controller can control the display panel to operate in one driving mode selected from among dot inversion, column inversion and frame inversion depending on an inversion driving control signal transmitted from the host system 150. Here, the inversion driving control signal transmitted from the host system 150 can be the signal that is generated depending on the difference in the data value between the image signals of the specific frame. Accordingly, the display device driving method 700 of this embodiment may preclude some of the above-mentioned steps, and include the steps of receiving image signals of a specific frame and controlling the display panel to operate in one driving mode selected from among dot inversion, column inversion and frame inversion depending on the difference in the data value between the image signals of the specific frame.

Figure 8:
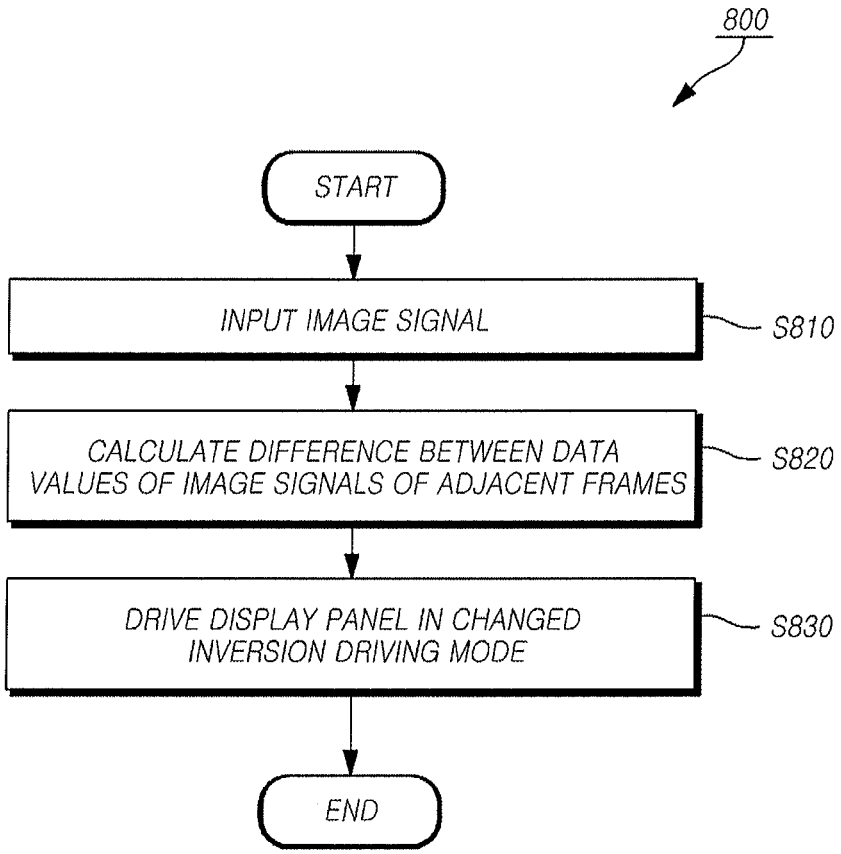
FIG. 8 is a flowchart showing another exemplary embodiment of the method of driving a display device according to the present invention.

FIG. 8 is a flowchart showing another exemplary embodiment of the display device driving method according to the present invention.

Referring to FIG. 8, the display device driving method 800 according to this embodiment includes step S810 of receiving image signals of adjacent frames, step S820 of calculating a difference between data values of image signals of the adjacent frames, and step S830 of controlling the display panel to be driven at a drive frequency that changes depending on a variation in the image signals between the adjacent frames.

At step S810, the display device 100 receives image signals RGB and timing signals Vsync, Hsync and DE transmitted from the host system 150.

At step S820, the display device can calculate a gray difference in the image signals between the adjacent frames. The variation in the image signals between the adjacent frames is calculated by obtaining the gray difference (difference) in the image signals between the adjacent frames.

At step S830, the display device 100 can change the drive frequency of an Nth frame to a frequency for ordinary driving, for example, 60 Hz, when the calculated variation in the image signals between the adjacent frames is equal to or greater than a reference amount. When the calculated variation is less than the reference amount, the display device 100 can change the drive frequency to a frequency for low speed driving, for example, 40 Hz.

Figure 9:
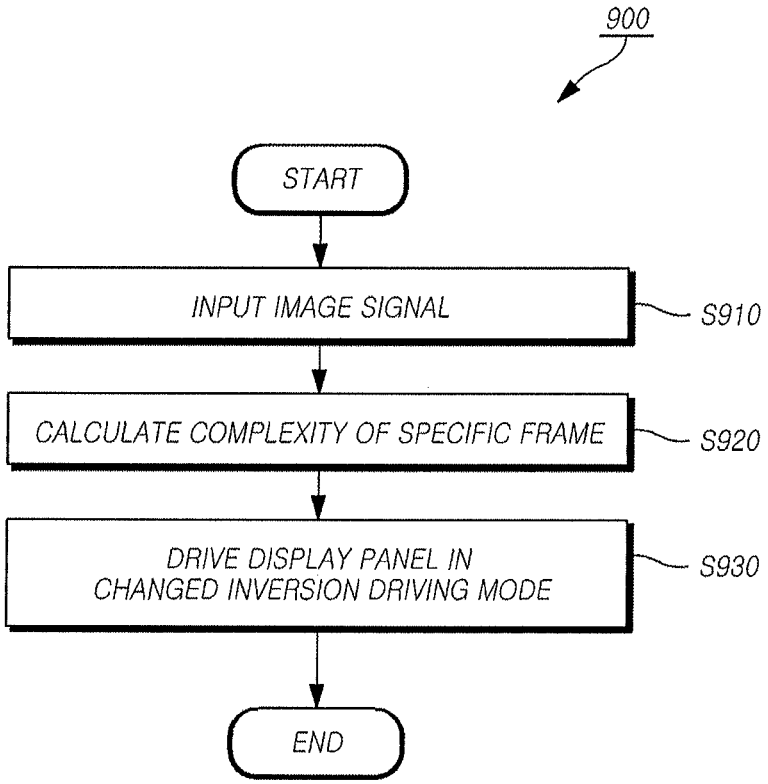
FIG. 9 is a flowchart showing a further exemplary embodiment of the method of driving a display device according to the present invention.

FIG. 9 is a flowchart showing a further exemplary embodiment of the display device driving method according to the present invention.

Referring to FIG. 9, the display device driving method 900 according to this embodiment includes step S910 of receiving an image signal of a specific frame, step S920 of calculating the complexity of the image signal of the specific frame, and step S930 of controlling the display panel to be driven at a drive frequency that changes depending on the complexity of the image signal of the specific frame.

At step S910, the display device 100 receives an image signal RGB and timing signals Vsync, Hsync and DE of a specific frame, transmitted from the host system 150.

Figure 6:
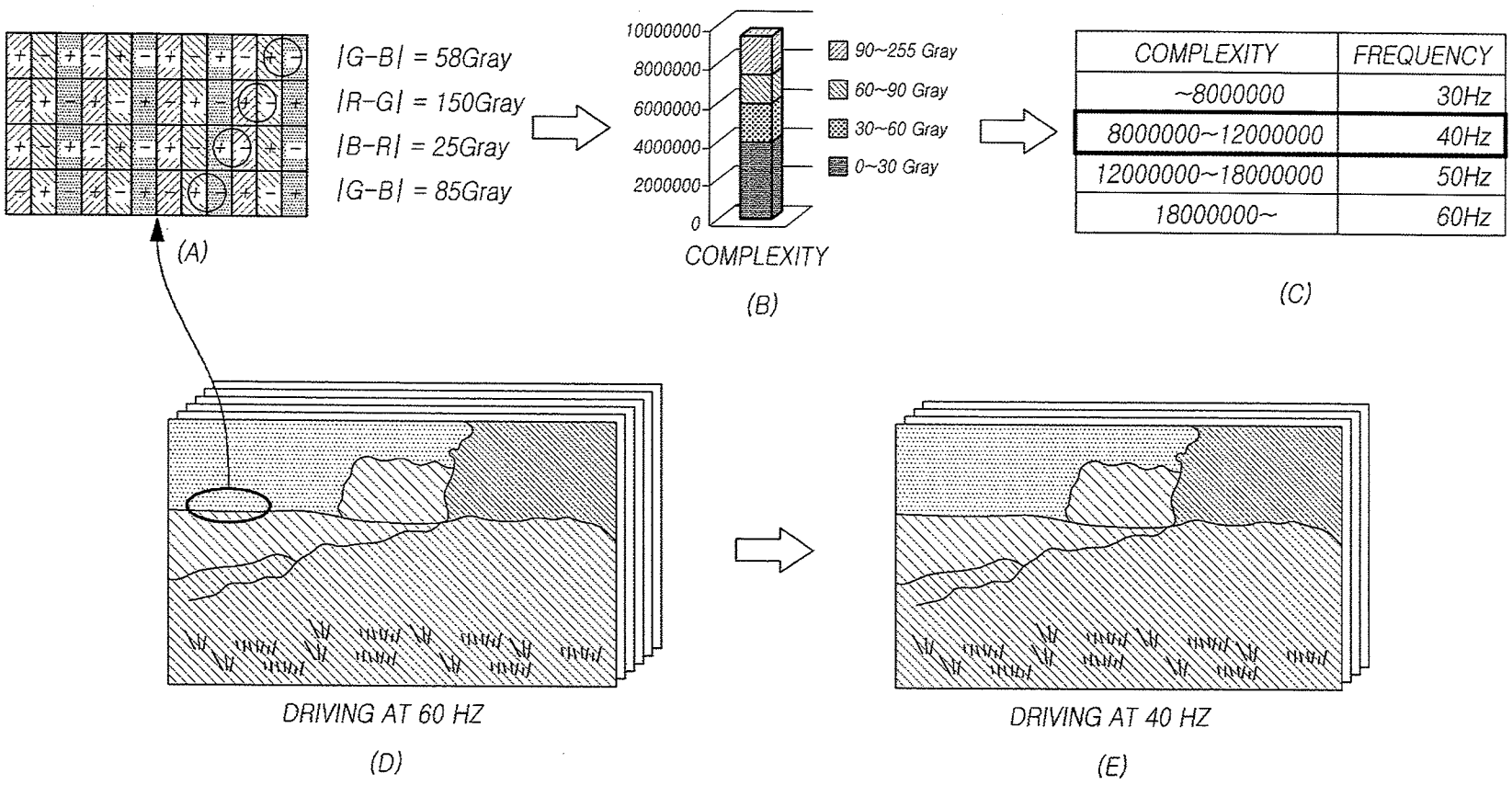
FIG. 6 shows a process in which the timing controller shown in FIG. 1 changes a drive frequency depending on complexity.

At step S920, the display device 100 calculates gray differences between adjacent pixels within the specific frame, for example, 58, 150, 25 and 85 gray scales, as shown in part (a) of FIG. 6, and calculates complexity by adding up the gray differences, as shown in part (b) of FIG. 6.

At step S930, the display device 100 can change the drive frequency of the specific frame to 40 Hz when the calculated complexity ranges from 9,000,000 to 12,000,000, as shown in part (c) of FIG. 6.

Figure 10:
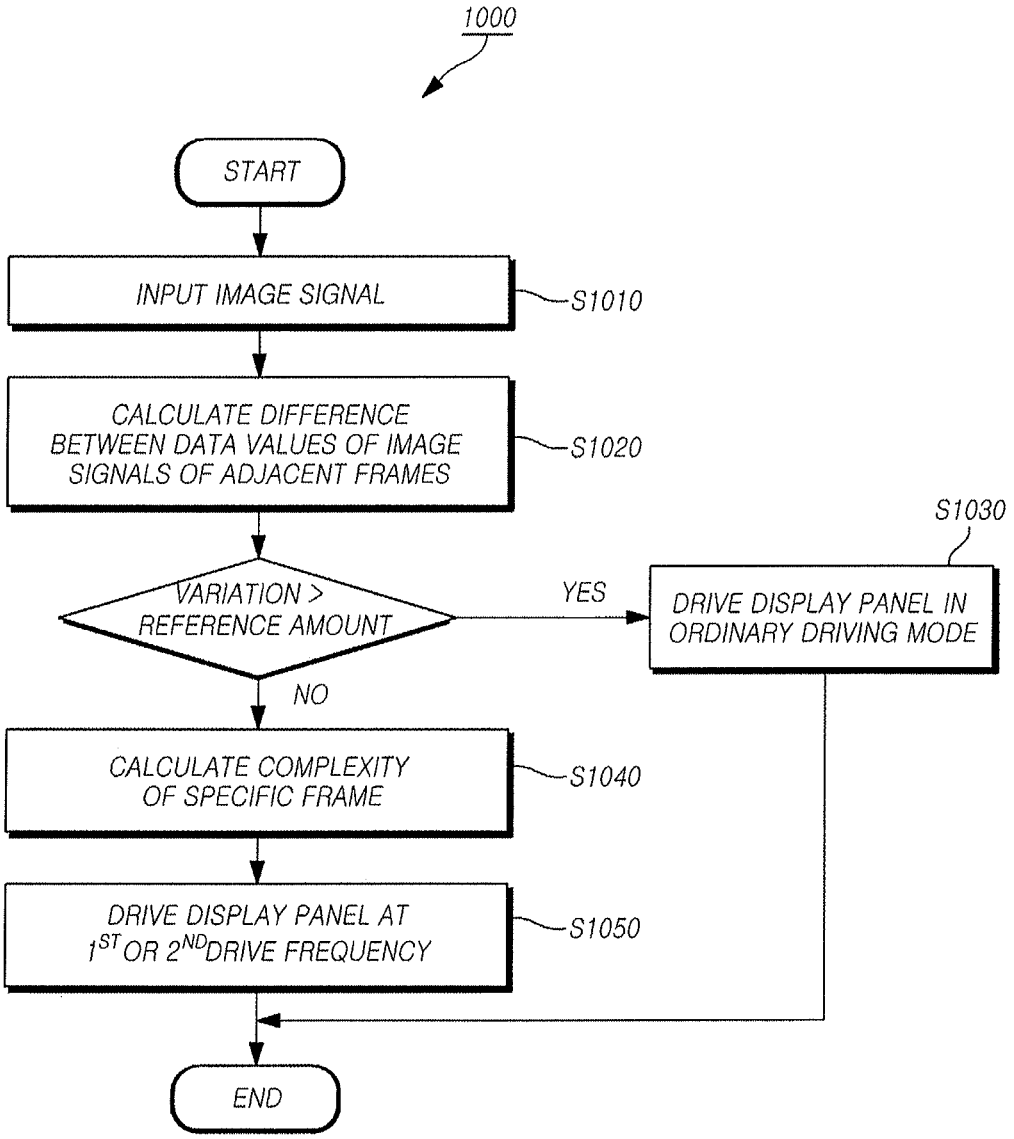
FIG. 10 is a flowchart showing still another exemplary embodiment of the method of driving a display device according to the present invention.

FIG. 10 is a flowchart showing still another exemplary embodiment of the display device driving method according to the present invention.

Referring to FIG. 10, the display device driving method 1000 according to this embodiment includes step S1010 of receiving image signals of adjacent frames, step S1020 of calculating a difference in the data value between the image signals between the adjacent frames, step S1030 of determining a variation in the image signals between the adjacent frames, and when the variation in the image signals between the adjacent frames is equal to or greater than a reference amount, controlling the display panel to be driven at a frequency for ordinary driving, step S1040 of determining a variation in the image signals between the adjacent frames, and when the variation in the image signals between the adjacent frames is less than the reference amount, calculating the complexity of the image signals within a specific frame, and step S1050 of changing the drive frequency of the display panel to a first drive frequency or a second drive frequency depending on the complexity of the image signals within the specific frame.

At step S910, the display device 100 receives image signals RGB and timing signals Vsync, Hsync and DE between adjacent Nth and N−1th frames, transmitted from the host system 150.

Step S1020 is identical with step S820, which was described with reference to FIG. 8.

After the difference in the data value between the image signals between the adjacent frames is calculated at step S1020, at step S1030, the variation in the image signals between the adjacent frames is determined, and when the variation in the image signals between the adjacent frames is equal to or greater than a reference amount, the display panel is controlled to be driven at a frequency for ordinary driving (e.g. 60 Hz).

At step S1040 and step S1050, when the variation in the image signals between the adjacent Nth and N−1th frames is less than the reference amount, the drive frequency of the display panel is determined to be a first drive frequency (e.g. 40 Hz). After that, the drive frequency can be changed to a second drive frequency (e.g. 30 Hz) that is lower than the first drive frequency, depending on the complexity of the image signals within the Nth frame. Afterwards, the display panel is controlled to be driven at the first or second drive frequency depending on the complexity of an image signal of a specific frame.

The foregoing embodiments of the method of driving a display device, which have been described with reference to FIG. 7 to FIG. 10, can be executed by a specific element of the display device which was described with reference to FIG. 1. For example, the foregoing embodiments of the method can be executed by the timing controller 110, which was described with reference to FIG. 2 to FIG. 6, or can be executed by another element, either described herein or not.

Although it has been described in the foregoing embodiments that the display device 100 controls the display panel to operate in a driving mode that changes depending on an image signal based on the result of analysis on the image signal, the present invention is not limited thereto. The display device, for example, the timing controller can control the display panel to operate in a driving mode that changes depending on a drive control signal transmitted from the host system 150.

Although in the foregoing embodiments, the timing controller changes the driving mode by receiving image signals of a specific drive frequency from the host system 150, reference will now be made to an embodiment in which the host system 150 changes the drive frequency of image signals and the timing controller controls the display panel by receiving the image signals at the changed drive frequency.

Fourth Embodiment

Figure 11:
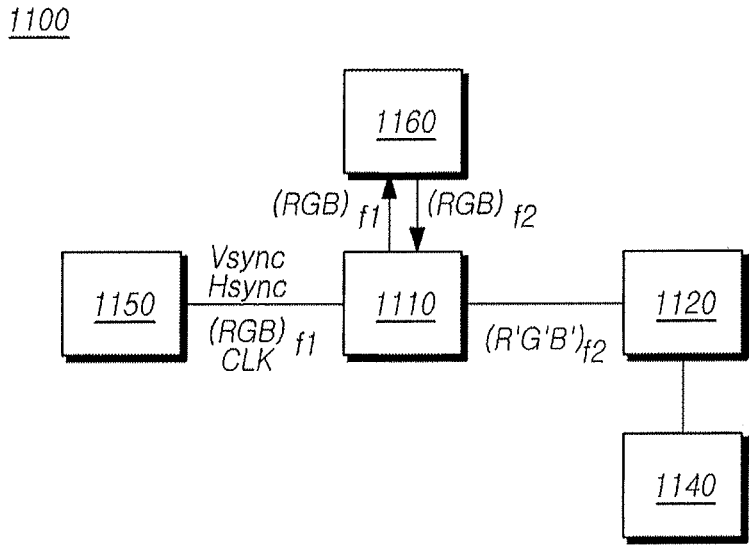
FIG. 11 is a view showing the system configuration of a display device according to a fourth exemplary embodiment.

FIG. 11 is a view showing the system configuration of a display device according to a fourth exemplary embodiment.

Referring to FIG. 11, the display device 1100 includes a timing controller 1110 which controls the operation of a display panel 1140, a data driver 1120 connected to a plurality of data lines, the display panel 1140 on which the plurality of data lines and the plurality of gate lines intersect each other in the form of a matrix in which pixels are defined at the intersections, and a host system 150 which supplies timing signals, such as vertical and horizontal synchronization signals Vsync and Hsync, a data enable signal DE and a clock signal CLK, and image signals RGB to the timing controller 1110. Although not shown in FIG. 11, the display device 1100 includes the gate driver 130 shown in FIG. 1.

The display device 1100 further includes a memory 1160, which may be a frame buffer.

The host system 1150 supplies an image signal $(RGB)_{f1}$ of a first drive frequency f1 lower than an input drive frequency f0 to the timing controller 1110 in case of a moving image, in which variation in an image signal is insignificant, or a still image. For example, when a still image of 60 Hz is input, the host system 1150 latches only an image signal of 30 Hz and outputs the latched image signal to the timing controller 1100.

When the input drive frequency f0 of a source image signal is 2f1, the host system 1150 may output the image signal $(RGB)_{f1}$ of the first drive frequency f1 by dividing the input drive frequency into groups of odd and even frames and skipping one frame group. For example, when the input drive frequency f0 of the source image signal is 60 Hz, the host system 1150 may output an image signal of 30 Hz by dividing the image signal of 60 Hz into two frame groups, i.e. a group of odd frames and a group of even frames.

The timing controller 1100 stores the image signal $(RGB)_{f1}$ of the lower first drive frequency f1 in the memory 1160. The timing controller 1100 reading out the image signal $(RGB)_{f1}$ stored in the memory 1160 at a higher second drive frequency. The second drive frequency f2 is m times the first drive frequency f1, where m is a real number greater than 1.

Figure 12:
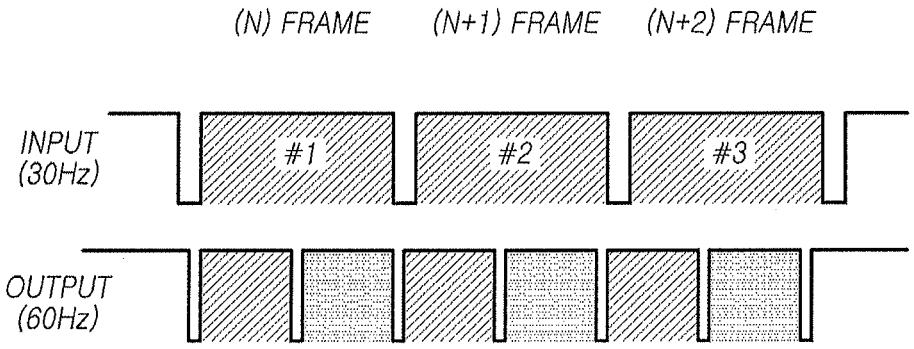
FIG. 12 shows an example in which a first drive frequency f1 stored in FIG. 11 is 30 Hz and a second drive frequency f2 is 60 Hz.

The timing controller 1110 may output an image signal $(RGB)_{f2}$ of the second drive frequency f2, which is multiple times (e.g., two, three or four times) the first drive frequency f1, from the image signal $(RGB)_{f1}$ of the first drive frequency f1 stored in the memory 1160 by repeatedly outputting the same data stored in the memory 1160 by data multiplying. Herein, the term "data multiplying" refers to the process of reading out the same data stored in the memory by a multiplicity of times, as in data doubling. For example, since the same data stored in the memory 1160 is output twice by data doubling, it is possible to output the image signal $(RGB)_{f2}$ of the second drive frequency f2, which is twice the first drive frequency f1, from the image signal $(RGB)_{f1}$ of the first drive frequency f1 stored in the memory 1160. As shown in FIG. 12, when the stored first drive frequency f1 is 30 Hz, the second drive frequency f2 may be 60 Hz.

As an alternative, the timing controller may output the image signal $(RGB)_{f2}$ of the second drive frequency f2 from the image signal $(RGB)_{f1}$ of the first drive frequency f1 stored in the memory 1160 by selectively and repeatedly outputting the same data stored in the memory 1160. For example, the first half of the same data stored in the memory 1160 is output twice and the second half of the same data is output once, such that the image signal $(RGB)_{f2}$ of the second drive frequency f2, which is one and half times the first drive frequency f1, is output from the image signal $(RGB)_{f1}$ of the first drive frequency f1 stored in the memory 1160. When the stored first drive frequency f1 is 30 Hz, the second drive frequency f2 may be 45 Hz.

The timing controller 1110 supplies the image signal $(RGB)_{f2}$ of the higher second drive frequency f2 to the display panel 1140 via the data driver 1120.

In the foregoing example as described above, the timing controller 1110 outputs the image signal $(RGB)_{f2}$ of the second drive frequency f2 higher than the first drive frequency f1, and drives the display panel 1140 via the data driver 1120. It is therefore possible to reduce flickering caused by low speed driving in which the display panel 1140 is driven at the first drive frequency f1.

Figure 13:
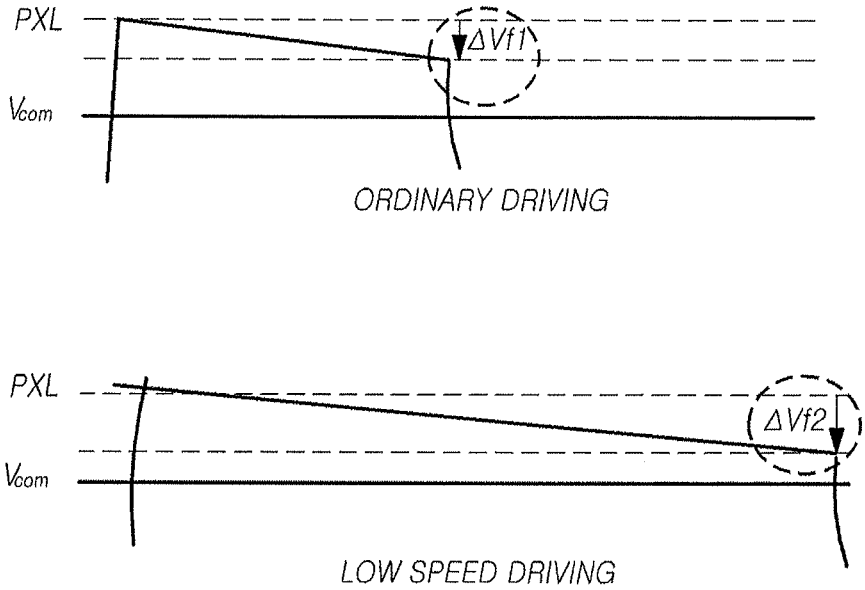
FIG. 13 shows the states of voltages charged in a storage capacitor of the display panel when the display panel is driven at the first drive frequency and when the display panel is driven at the second drive frequency.

FIG. 13 shows the states of voltages charged in a storage capacitor of the display panel when the display panel is driven at the first drive frequency and when the display panel is driven at the second drive frequency.

Although the low speed driving in which the display panel 1140 is driven at the first drive frequency f1 may reduce the amount of power consumed by the display device 1100, it may cause the problem of quality distortion such as screen flickering or afterimages. The screen flickering occurs during the low speed driving since the driving time of the low speed driving is longer than that of the ordinary driving. In the low speed driving, as shown in FIG. 13, the voltage charged in the storage capacitor Cst descends without maintaining the required level for the longer driving time, thereby causing different pixel values.

However, in the foregoing example as described above, when the timing controller 1110 outputs the image signal $(RGB)_{f2}$ of the second drive frequency f2, which is twice the first drive frequency f1, and drives the display panel 1140 via the data driver 1120, a voltage difference $\Delta V_{f2}$, i.e. a decrease in the voltage charged in the storage capacitor Cst with time, is significantly greater than a voltage difference $\Delta V_{f1}$ in the case in which the display panel 1140 is driven at the first drive frequency f1. Since the charged voltage is maintained in the storage capacitor Cst, it is possible to reduce the screen flickering caused by the low speed driving in which the display panel 1140 is driven at the first drive frequency f1.

In addition, with regard to the circuit, an intra interface outputs the same data to the liquid crystal. However, the data is received in a low speed to the system interface, which receives the data from the host system 1150 as an input. Therefore, reduced power consumption is expected in input/output logics. Furthermore, it is possible to expect reduced power consumption in the host system 1150 that is driven in a low speed.

In the foregoing example, the memory 1160, which is the frame buffer, may be added to the host system 1150, such that the host system 1150 may execute data multiplying. In this case, although power reduction is expected only in the host system 1150, the memory 1160 added to the timing controller 1110 may be shared with the memory of the host system 1150, thereby reducing the cost.

The host system 1150 is more effective when classifying image sources to be produced. For example, when the host system 1150 is applied to still images or a movie (the image sources of the movie are typically 24 fps), it is possible to remove breaks and quality distortion during transition that would otherwise occur in the low speed driving. In the case of source images requiring fast screen transition, such as game or sports images, breaks occur when data multiplying is applied. A configuration or logic for determining source images may be added to the host system 1150 for the combined use of the low speed driving and the ordinary driving, thereby making the host system 1150 more effective.

According to the fourth embodiment as described above, it is possible to reduce the amount of power consumed by the entire circuit including the timing controller 1110 or the host system 1150. In addition, according to the above-described fourth embodiment, it is possible to reduce flickering that occurs while the low speed driving is performed.

Figure 14:
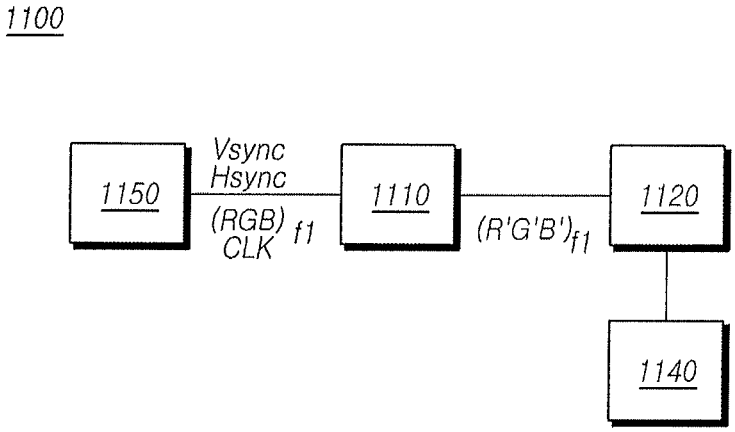
FIG. 14 shows an example in which the timing controller drives the display panel with image signals $(R'G'B')_{f1}$ of the first drive frequency f1.

It has been described in the fourth embodiment that, when the input drive frequency f0 of a source image is greater than the first drive frequency f1, for example, when the input drive frequency f0 is 2f1, the host system 1150 outputs an image of the first drive frequency f1 and the timing controller 1110 drives the display panel 1140 at the second drive frequency f2, which is greater than the first drive frequency f1. Alternatively, as shown in FIG. 14, the timing controller 1110 may drive the display panel 1140 with an image signal $(R'G'B')_{f1}$ of the first drive frequency f1.

Figure 15:
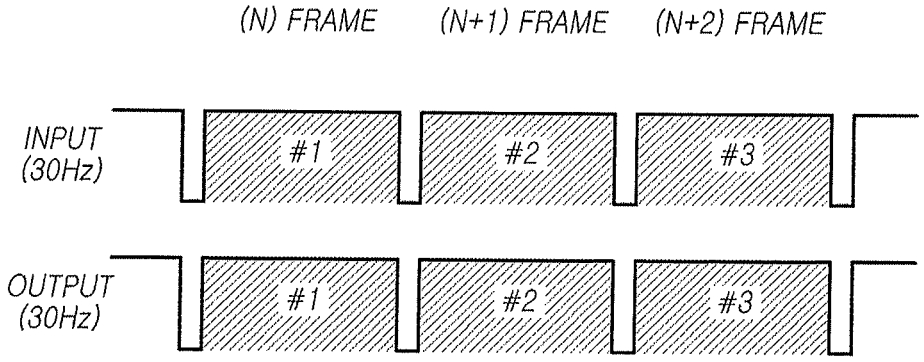
FIG. 15 shows an example in which the host system and the display panel are driven at 30 Hz when the frequency of a source image is 60 Hz.

Since the effect of flickering is insignificant in the low speed driving, it is more effective to reduce not only the speed of the host system 1150 but also the speed of the display panel 1140 in order to further reduce power consumption. For example, as shown in FIG. 15, considering a case in which the frequency of a source image is 60 Hz, the host system 1150 may also drive the display panel 1140 at 30 Hz, thereby further reducing power consumption. Consequently, the amount of power consumed for the source image can be reduced by a greater amount than for still images.

In case of a moving image, in which variation in an image signal is insignificant, or a still image, the host system 1150 supplies the image signal $(RGB)_{f1}$ of the first drive frequency f1, which is lower than the input drive frequency, to the timing controller 1110. For example, when a still image of 60 Hz is input, the host system 1150 latches only an image signal of 30 Hz and outputs the latched image signal to the timing controller 1100.

Figure 16:
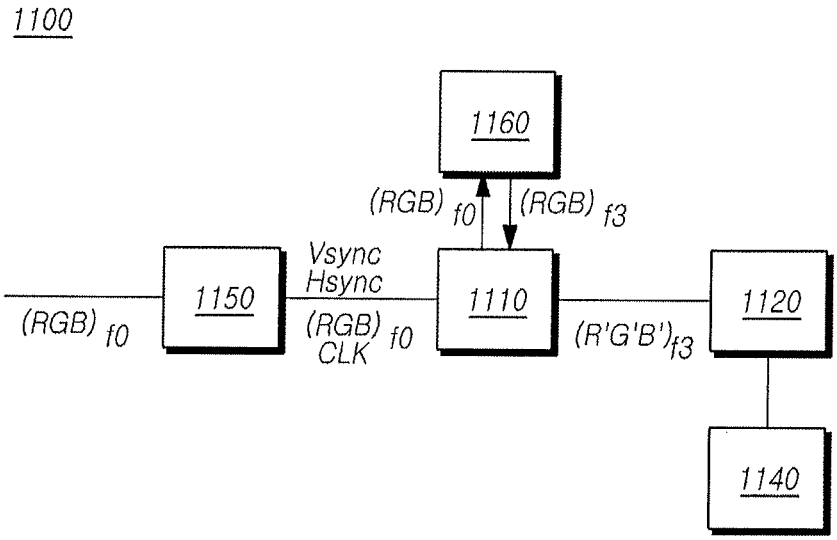
FIG. 16 shows an example in which the host system outputs signals at the same drive frequency as the input drive frequency f0 of the source image and the timing controller drives the display panel with image signals $(R'G'B')_{f1}$ of a third drive frequency f3, which is greater than the input drive frequency f0, by data multiplying.

It has been described in the fourth embodiment that, when the input drive frequency f0 of a source image is greater than the first drive frequency f1, for example, when the input drive frequency f0 is 2f1, the host system 1150 outputs a signal at the first drive frequency f1 and the timing controller 1110 drives display panel 1140 at the second drive frequency f2. Alternatively, as shown in FIG. 16, the host system 1150 mayp output a signal at the same drive frequency as the input drive frequency f0 of the source image, and the timing controller 1110 may drive the display panel 1140 with an image signal $(R'G'B')_{f3}$ of a third drive frequency f3, which is greater than the input drive frequency f0, by data multiplying in the same manner as described above in the fourth embodiment. Comparing to the above embodiment, the input drive frequency f0 corresponds to the first drive frequency f1 described with reference to FIG. 11 in the fourth embodiment, and the third drive frequency f3 corresponds to the second drive frequency f2.

Here, the timing controller 1110 may drive the display panel 1140 with the image signal $(R'G'B')_{f3}$ of the third drive frequency f3, such that the image is displayed on the display panel 1140 for a predetermined time but is not displayed on the display panel 1140 for the remaining time. Specifically, when the timing controller 1110 drives the display panel 1140 with the image signal $(R'G'B')_{f3}$ of the third drive frequency f3, the timing controller 1110 may turn on the output of the data driver 1120 for predetermined time periods (for first time periods in Nth, N+1th and N+2th frames) such that the image is displayed on the display panel 1140 but may turn off the output of the data driver 1120 for the remaining time periods (for second time periods in the Nth, N+1th and N+2th frames) such that the image is not displayed on the display panel 1140.

Figure 17:
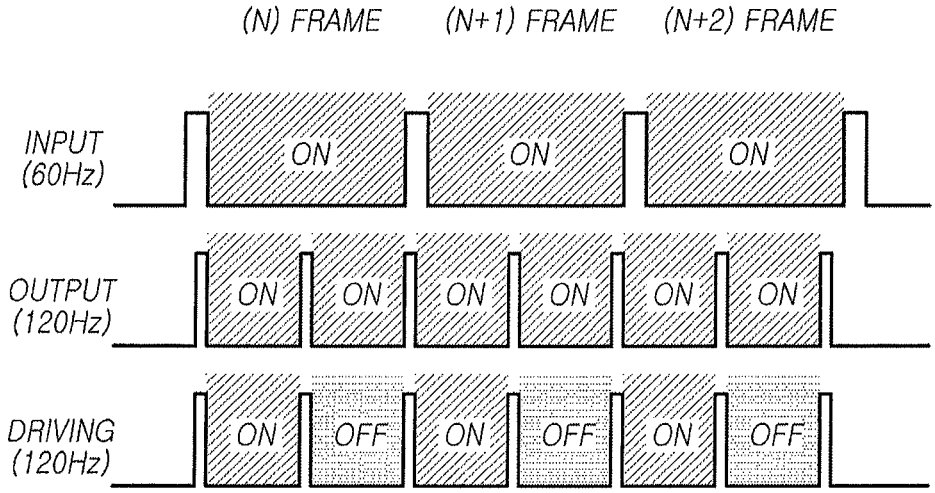
FIG. 17 shows an example in which the input drive frequency f0 stored in FIG. 16 is 60 Hz and the third drive frequency f3 is 120 Hz.

The timing controller 1110 may output the image signal $(R'G'B')_{f3}$ of the third drive frequency f3, which is multiple times (e.g., two, three or four times) the input drive frequency f0, from the image signal $(RGB)_{f0}$ of the input drive frequency f0 stored in the memory 1160 by repeatedly outputting the same data stored in the memory 1160 by data multiplying. For example, since the same data stored in the memory 1160 is output twice by data doubling, it is possible to output the image signal $(RGB)_{f3}$ of the third drive frequency f3, which is twice the first drive frequency f1, from the image signal $(RGB)_{f1}$ of the first drive frequency f1 stored in the memory 1160. As shown in FIG. 17, when the stored first drive frequency f1 is 60 Hz, the second drive frequency f3 may be 120 Hz.

As an alternative, the timing controller may output the image signal $(RGB)_{f3}$ of the third drive frequency f3 from the image signal $(RGB)_{f0}$ of the input drive frequency f0 stored in the memory 1160 by selectively and repeatedly outputting the same data stored in the memory 1160. For example, the first half of the same data stored in the memory 1160 is output twice and the second half of the same data is output once, such that the image signal $(RGB)_{f3}$ of the third drive frequency f3, which is one and half times the input drive frequency f0, is output from the image signal $(RGB)_{f0}$ of the input drive frequency f0 stored in the memory 1160. When the stored input drive frequency f0 is 60 Hz, the third drive frequency f3 may be 90 Hz.

For example, as shown in FIG. 17, when the input drive frequency is 60 Hz, it is possible to display the image on the display panel 1140 while driving the display panel 1140 at 120 Hz, which is greater than the input drive frequency of 60 Hz. In addition, the data driver 1120 is stopped in a standby state for the remaining time periods to consume a minimum amount of power, thereby reducing power consumption.

Accordingly, in the case of fast moving images, it is possible to increase the drive frequency instead of decreasing the drive frequency due to breaks in the screen while stopping the data driver 1120 for predetermined time periods, thereby reducing power consumption. Consequently, according to the above-described embodiment, it is possible to drive the display panel 1140 at a drive frequency greater than the input drive frequency without any quality problem, such as screen flickering or breaks, while reducing power consumption by stopping the circuit for predetermined time periods.

Figure 18:
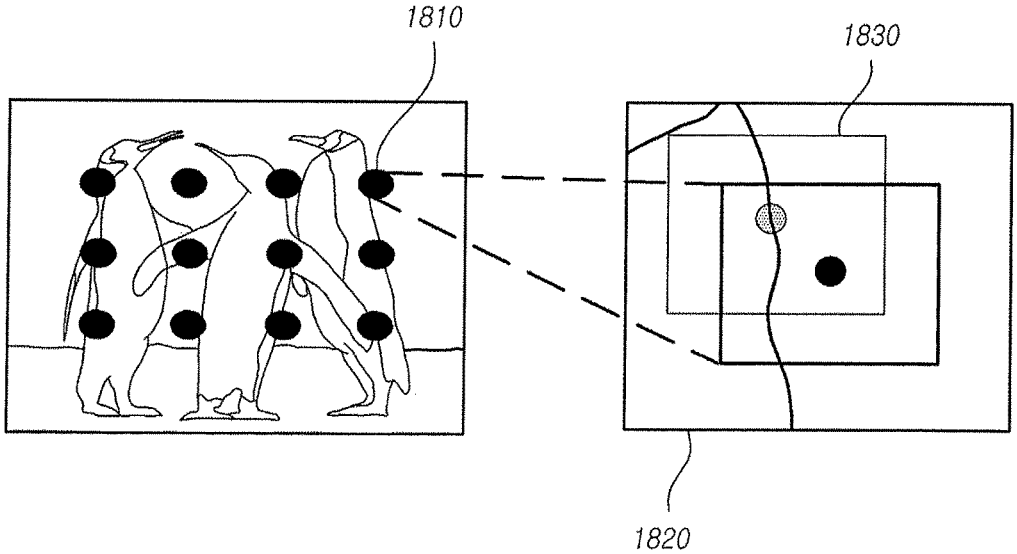
FIG. 18 shows an example in which source images are classified using a motion vector.

In the above-described embodiments, the host system 160/1160 or the timing controller 110/1110 changes the driving method by dividing a source image. Accordingly, the source images are required to be classified. For example, as shown in FIG. 18, source images may be classified using a motion vector. Dots 1810 in the left part of FIG. 18 indicate sampled search points. Windows 1820 and 1830 in the right part of FIG. 18 indicate reference areas in use for comparison, and P $(x_1, y_1)$ indicates a center point. The first window 1820 is a searching area in use for searching, and the second window 1830 is a detected area that has been searched, in which P $(x_2, y_2)$ indicates a center point.

It is possible to most accurately determine the type of the source image by calculating a motion vector for each of the dots 1810. In this case, the type of the source image can be determined within a driving time, since the amount of calculation is reduced by searching from the surroundings with reference to the sampled dots 1810, as shown in FIG. 18. In addition, the searched position is compared with the original position, whereby the motion vector as in Formula 4 is obtained. A total of such values is obtained by performing the calculation on all of the sampled dots 1810. The greater the total value is, the faster the moving image is. An image having a smaller total value is classified as a slow moving image or an ordinary moving image. When the total value is 0 or smaller than a threshold value, the corresponding image may be classified as a still image.

$$\text{Motion Vector}=|P(x_1)-P(x_2)+P(y_1)-P(y_2)| \qquad \text{Formula 4}$$

Accordingly, image sources can be classified into still images, slow moving images and fast moving images according to predetermined thresholds, and the driving mode can be changed according to the classified image sources, thereby effectively reducing power consumption.

The display device and the method of driving the same according to the foregoing embodiments can reduce power consumption by properly adjusting the inversion driving mode depending on the image signal or the image. The display device and the method of driving the same according to the foregoing embodiments can reduce power consumption by properly changing the drive frequency depending on the image. That is, the display device and the method of driving the same according to the foregoing embodiments can minimize power consumption by allowing the display panel to operate in the driving mode that changes depending on the image signal.

Although the certain embodiments of the present invention have been described with reference to the drawings, the present invention is by no means limited thereto.

Although the display panel was described as being the LCD panel for the illustrative purposes in the foregoing embodiments, the present invention is not limited thereto. The display panel can be any other display panel such as an organic light-emitting diode display (OLED).

Although it was described in the foregoing embodiments that the drive frequency is divided into the frequency for ordinary driving and the frequency for low speed driving and the drive frequency of a specific frame is changed from the frequency for ordinary driving to the frequency for low speed driving. In contrast, it is possible to change the frequency for ordinary driving with the frequency for low speed driving or a frequency for high speed driving. Here, the frequency for high speed driving is higher than the frequency for ordinary driving.

It will be understood that the terms "comprise", "include" and "have" used herein specify the presence of stated elements but do not preclude the presence or addition of any other elements unless explicitly noted. Unless otherwise defined, all terms including technical and scientific terms used herein have the same meaning as commonly understood by a skilled person in the art to which the present invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The foregoing descriptions and the accompanying drawings have been presented in order to explain the certain principles of the present invention. A person skilled in the art to which the invention relates can make many modifications and variations without departing from the principle of the invention. The foregoing embodiments disclosed herein shall be interpreted as illustrative only not as limitative of the principle and scope of the invention. It should be understood that the scope of the invention shall be defined by the appended Claims and all of their equivalents fall within the scope of the invention.

What is claimed is:

1. A display device comprising:

a display panel on which a plurality of data lines and a plurality of gate lines intersect each other to form a matrix, with a number of pixels being defined at intersections of the plurality of data lines and the plurality of gate lines;

a data driver connected to the plurality of data lines;

a memory storing an image signal of a first drive frequency input from a host system; and a timing controller that controls the display panel to be driven with an image signal of a second drive frequency obtained from the image signal stored in the memory by data multiplying, the second drive frequency being two times the first drive frequency, wherein the timing controller, in use:

outputs to the data driver the image signal at the second drive frequency during successive first and second time periods of a same frame, the first and second time periods respectively corresponding to first and second cycles of the second drive frequency and having a same duration, turns on an output of the data driver during the first period and controls the data driver to output the image signal at the second drive frequency to the display panel, and controls the data driver to go into a power consumption reduction standby state by turning off the output of the data driver and stopping the data driver from outputting any image signal at the second drive frequency to the display panel during the second time period of the same frame, thereby preventing the pixels from receiving data voltages during the second time period of the same frame.

2. The display device according to claim 1, wherein the first drive frequency of the image signal is lower than an input drive frequency of a source image.

3. The display device according to claim 2, wherein the source image is a still image, and wherein the first drive frequency is half the input drive frequency.

4. The display device according to claim 2, wherein the source image is a fast moving image.

5. The display device according to claim 1, wherein the image signal of the first drive frequency is equal to an input drive frequency of a source image.

6. The display device according to claim 1, wherein the first drive frequency of the image signal input from the host system changes depending on a type of a source image classified using a motion vector of the source image.

7. The display device according to claim 6, wherein the type of the source image is classified using motion vectors of sampled dots of the source image.

8. A device, comprising:

a display panel including a plurality of data lines, a plurality of gate lines, and a plurality of pixels disposed at respective intersections of the plurality of data lines and the plurality of gate lines;

a data driver connected to the plurality of data lines and configured to supply data voltages to the plurality of data lines;

a memory storing an image signal having a first drive frequency; and a timing controller configured to:

obtain an image signal having a second drive frequency by data multiplying the image signal having the first drive frequency, the second drive frequency being two times the first drive frequency, output the image signal having the second drive frequency to the data driver during successive first and second portions of a same frame periods, the first and second portions of the frame period respectively corresponding to first and second cycles of the of the second drive frequency and having a same duration, control the data driver to supply the data lines with data voltages according to the image signal having the second drive frequency during the first portion of a frame period, and turn off an output of the data driver during the second portion of the frame period, wherein the data lines do not receive data voltages during the second portion of the frame period.

9. The device of claim 8, wherein the timing controller is further configured to receive the image signal having the first drive frequency from a host system, and to provide the received image signal having the first drive frequency to the memory.

10. The device of claim 8, wherein the first drive frequency of the image signal is less than an input drive frequency of a source image.

11. The device of claim 10, wherein the source image is a still image, and wherein the first drive frequency is half the input drive frequency.

12. The device of claim 10, wherein the source image is a fast moving image.

13. The device of claim 8, wherein the first drive frequency is equal to an input drive frequency of a source image.

14. The device of claim 8, wherein the first drive frequency of the image signal input from a host system changes depending on a type of a source image classified using a motion vector of the source image.

15. The device of claim 14, wherein the type of the source image is classified using motion vectors of sampled dots of the source image.

* * * * *